United States Patent [19]

Hollingsworth

[11] 4,147,213

[45] Apr. 3, 1979

[54] COMBUSTION AIR INJECTION WELL

[75] Inventor: Frank H. Hollingsworth, Tulsa, Okla.

[73] Assignee: Standard Oil Company (Indiana), Chicago, Ill.

[21] Appl. No.: 880,262

[22] Filed: Feb. 22, 1978

[51] Int. Cl.[2] ..... E21B 43/24; E21B 33/14

[52] U.S. Cl. ..... 166/256; 166/242; 166/245; 166/315

[58] Field of Search ..... 166/285, 256, 281, 315, 166/242, 57, 59, DIG. 1

[56] References Cited

U.S. PATENT DOCUMENTS

| | | | |
|---|---|---|---|
| 905,440 | 12/1908 | Layne | 166/315 X |
| 1,834,946 | 12/1931 | Halliburton | 166/285 |
| 2,644,523 | 7/1953 | Brown | 166/285 |
| 3,231,019 | 1/1966 | Clay et al. | 166/315 X |
| 3,504,745 | 4/1970 | Elkins | 166/261 |
| 3,531,236 | 9/1970 | Braddick et al. | 166/242 X |
| 4,083,408 | 4/1978 | Milam | 166/315 |

*Primary Examiner*—Stephen J. Novosad
*Assistant Examiner*—George A. Suchfield
*Attorney, Agent, or Firm*—Albert C. Metrailer

[57] ABSTRACT

Combustion air injection well completion comprising an outer casing having a reduced diameter lower portion and a small diameter liner casing which is run inside the outer casing and screwed into the upper end of the small diameter portion of the outer casing. The resulting completion provides an annular conduit through which cooling or divertent fluid may be injected into formations while combustion air is simultaneously pumped through the inner casing and into formations through perforations in the small diameter portion of the outer casing.

7 Claims, 2 Drawing Figures

COMBUSTION AIR INJECTION WELL

BACKGROUND OF THE INVENTION

This invention relates to the production of heavy petroleum from tar sands and the like and more particularly to an improved combustion air injection well design.

A method of producing petroleum from tar sands is described in U.S. Pat. No. 3,504,745, issued to Elkins and assigned to the assignee of the present invention. Basically, the method described involves a process of injecting air into the tar sand and initiating combustion to burn part of the tar and generate sufficient heat to reduce the viscosity of the remaining tar so that it may flow and be produced through a well. The patent also discloses some of the problems encountered in such operations and in particular the fact that the injected air tends to travel upward around the injection air wellbore. A solution to this problem taught by the patent is the injection of a foam-forming solution into the earth above the air injection point. This was accomplished by means of a small pipe or tubing which was placed into the well next to the normal casing and cemented into place with it. The small pipe ended above the air injection zone and was used to inject the soap solution which would then form a foam if air tried to pass through it and thereby block the air flow paths. This arrangement did not provide the desired blockage in all cases. This could be due to the fact that the soap solution was injected on only one side of the casing so that some vertical fractures on the opposite side may not have received the soap solution. It is also possible that the completion with two separate strings of pipe in the hole may prevent effective cementing due to the nonsymmetrical annulus and the creation of a trapped mud zone between the two pipe strings in the hole. In any case, it has been found that this type of completion does not always provide the desired vertical air blockage.

Accordingly, an object of the present invention is to provide an improved combustion air injection well completion.

Another object of the present invention is to provide an injection well completion providing means for uniformly injecting divertent fluid in all directions about the wellbore.

Another object of the present invention is to provide a combustion injection well having means for injecting a cooling fluid to protect the entire casing string from uncontrolled combustion zones above a divertent fluid injection depth.

Yet another object of the present invention is to provide a combustion air injection well completion which provides a uniform cementing annulus.

According to the present invention, the combustion air injection well is completed by means of an outer string having a large diameter upper portion and a smaller diameter lower portion connected together by a short swage and a small diameter liner casing positioned within the large diameter portion of the outer casing. The inner casing is screwed into the upper end of the small diameter portion of the outer casing. The outer casing is positioned in a wellbore such that the swage is located above a desired air injection level but below a desired divertent fluid injection level. The annulus between the inner and outer casings provides a conduit for injection of divertent or cooling fluid while the inner casing is used for injection of combustion air.

DESCRIPTION OF THE PREFERRED EMBODIMENT

Figure 1:
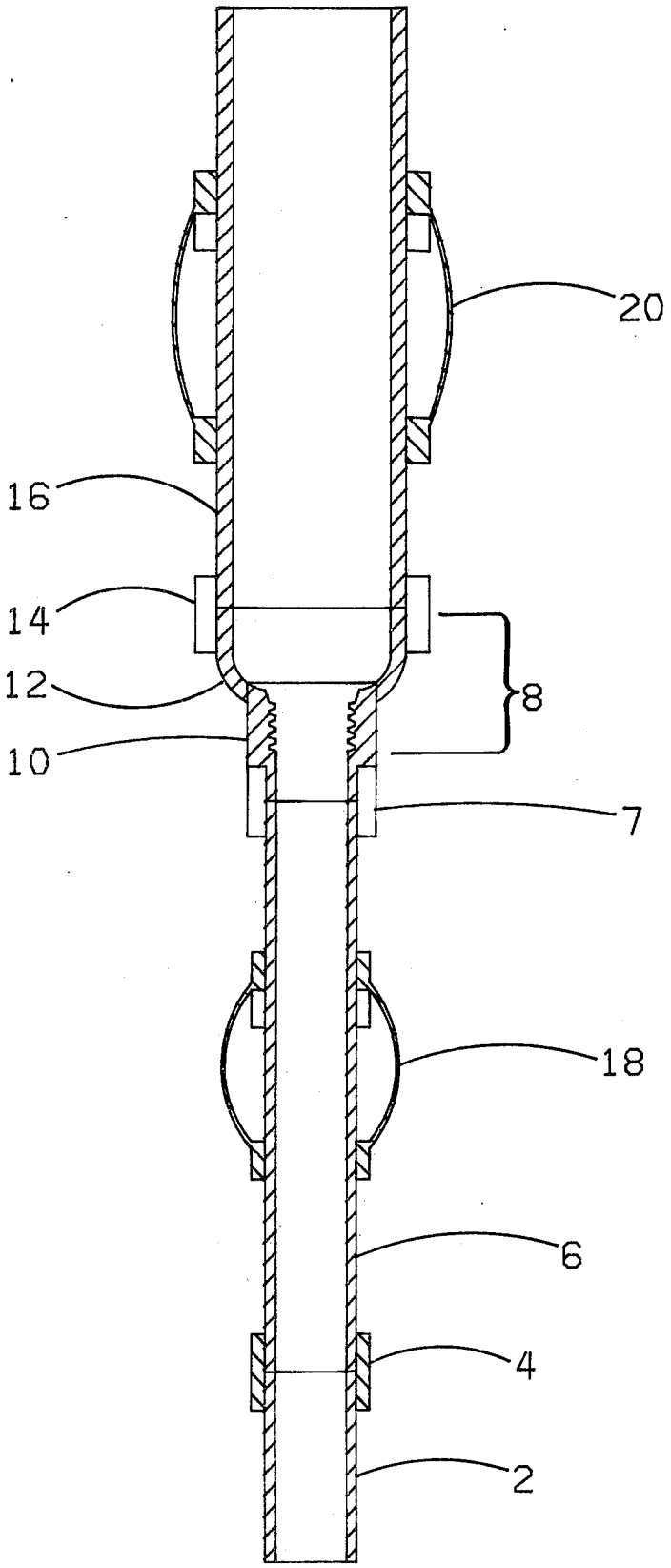
FIG. 1 is a cross-sectional illustration of a portion of the outer casing according to the present invention containing a swage section.

FIG. 1 illustrates in cross-sectional view the assembly of that portion of an outer casing according to the present invention containing a swage, that is, a diameter-reducing section. The lowest portion of this casing is assembled with standard 5½" diameter K-55 steel casing, weighing 15.5 lb/ft. The top of the last section of this standard steel pipe is designated as 2. A collar 4 is attached to the top end of casing 2 in the normal threaded-on manner, but the inner threads of the top half of collar 4 are bored out to an inner diameter of 5.575". A section 6 of high temperature alloy casing, also 5½" diameter, is positioned within collar 4 and welded into place. The upper end of casing section 6 has a high temperature alloy collar 7 welded into place. The high temperature alloy used in the preferred embodiment was a chrome-nickel-steel commonly known as Alloy 800 which conforms to the specification ASTM B-407. Other steels or alloys may be substituted according to the strength and temperature requirements of a particular well.

A swage shown generally as 8 is fabricated from several sections of high temperature alloy steel. The swage is basically formed from a short section of thick wall casing 10 and an end cap 12 which is bored out to accept the casing 10. The top portion of the inner surface of casing section 10 is threaded with a slightly tapered thread having a pitch of four threads per inch. The upper end of section 10 is welded to the end cap 12. The lower part of the outer surface of section 10 is turned down to slip into collar 7 and is welded to collar 7. An 8⅝" diameter high temperature alloy collar 14 is welded to the upper portion of end cap 12 and positioned to accept the lower end of an 8⅝" casing 16. Casing 16 is also high temperature alloy and is welded to collar 14. Additional lengths of 8⅝" casing are welded together in similar fashion above section 16 to whatever height the high temperature zone is expected to reach. Above that position, standard steel pipe and threaded collars are used. Also illustrated in FIG. 1 are centralizers 18 and 20 positioned below and above the swage 8 to assist in proper placement of the casing in a borehole.

Figure 2:
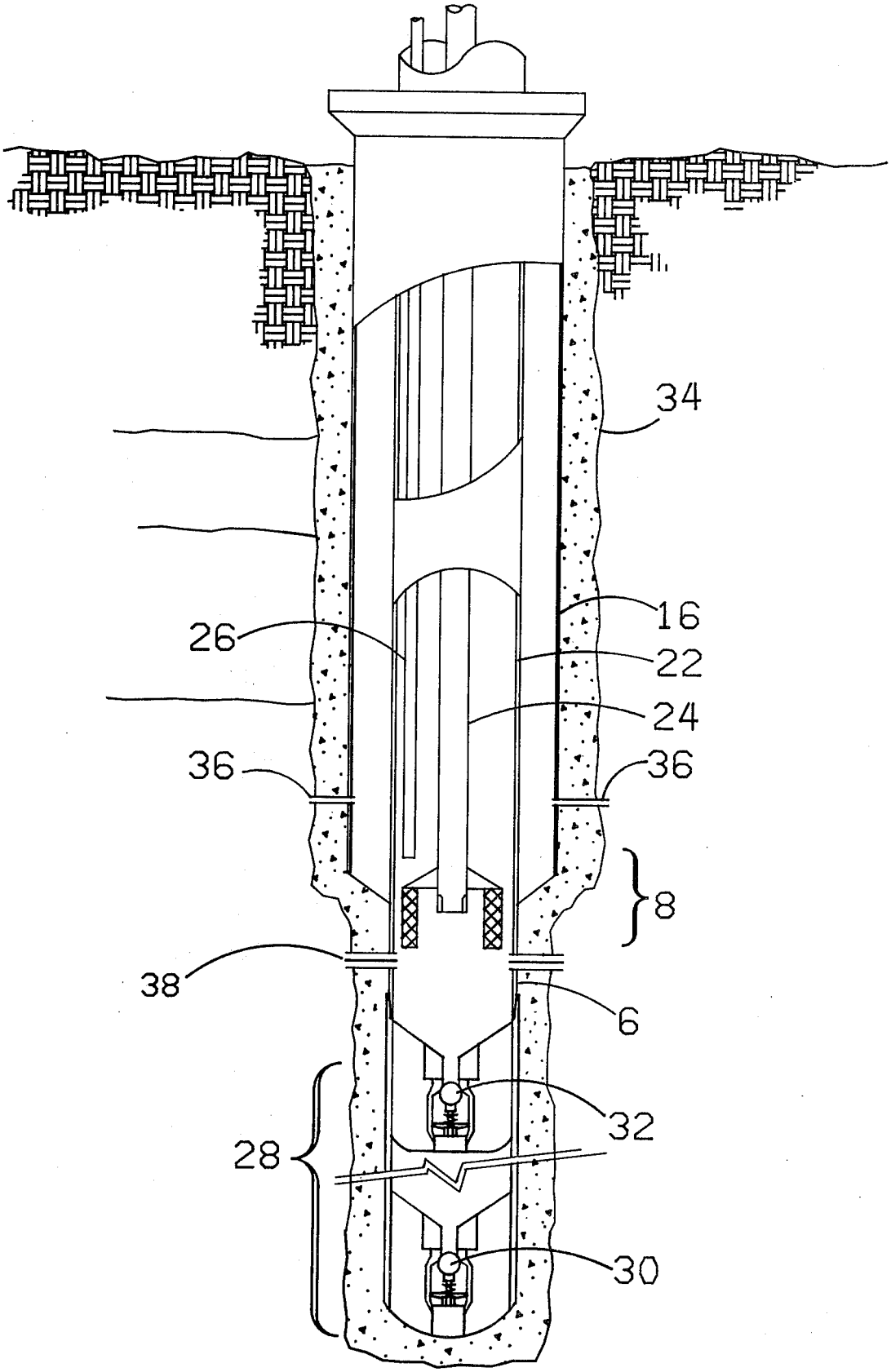
FIG. 2 is a cross section of a completed well according to the present invention.

FIG. 2 illustrates the final completed form of an air injection well in simplified version, that is, without showing each of the casing collars, centralizers, etc. The swage 8, small diameter lower casing 6, and large diameter upper casing 16 carry the same designation numbers as used in FIG. 1. In addition, an inner or liner casing 22 is illustrated extending from the ground surface to swage 8. This casing 22 is of the same size as casing 6 and is made of high temperature alloy steel through the high temperature zone. The outer surface of the bottom of this string 22 is threaded to mate with the threads formed on the inner surface of section 10 illustrated in FIG. 1. The final assembly as illustrated in FIG. 2 is made by lowering the casing 22 into the outer string 16 until the threads on sections 22 and 10 match up and then screwing liner 22 into casing 10.

Also illustrated in FIG. 2 is a 2⅜" tubing 24 and a 1" tubing 26. Tubing 24 is used to conduct a fuel to initiate combustion and tubing 26 is used to make temperature measurements in the injection well. Also illustrated in FIG. 2 is the lower section 28 of the outer casing which extends below the combustion zone and is made of normal steel pipe. In the preferred embodiment, a 5½" diameter float shoe 30 is attached to the bottom of the lowermost section of casing. A 5½" stab-in float collar 32 is positioned at the upper end of the lowermost section connecting it to the second section of pipe. Float shoe 30 and float collar 32 are commonly used elements which aid in the cementing operation.

The completion of a well, as illustrated in FIGS. 1 and 2 begins by assembling an outer string as illustrated in the figures. During assembly of the outer string, it is a good idea to check the thread match between the bottom of casing 22 and the inside of section 10 of swage 8 and to reserve parts which do match for the particular well. The outer string is then lowered into a wellbore and positioned so that swage 8 is located above a desired air injection depth and below the divertent fluid injection level. In the preferred embodiment, the casing is then cemented into the wellbore using the inner string cementing method. In this method, tubing or drill pipe is lowered into the casing and stabbed into the float collar 32. The cement is then pumped through this inner string and through the float collar 32 and float shoe 30 into the annulus around the casing. To obtain the best possible cement bond to the casing, it is preferred that the casing be rotated during the entire time that cement is being pumped through the annulus between the casing and the borehole.

After the cement, which is designated as 34 in FIG. 2, has hardened, divertent fluid perforations 36 are formed through outer casing 16 and the cement. In the preferred embodiment, 4 perforations are formed, spaced 90 degrees apart at the same depth. These perforations may be formed by any of the commercially available perforating techniques. After the divertent fluid perforations 36 are formed, the inner casing 22 is lowered into the outer casing and screwed into position. The contact between the inner casing 22 and the outer casing may be tested in two manners; the first is to apply tension to inner casing 22; the second is to pressurize the inner casing 22 and see if there is any flow into the annulus between casing 22 and the outer string 16. In the preferred embodiment, some leakage through the threaded connection is acceptable and will be minimized by the fact that the pressure differential across the joint is normally kept to the range of 100 lb/sq in. After verifying the connection between the inner and outer casings, perforations 38 are formed in the lower portion of the outer casing for air injection into the combustion zone. In the preferred embodiment, four perforations are made at each of several different levels in the borehole.

After all of the above steps have been performed, the well is essentially completed for combustion air injection purposes. Combustion air may be pumped down the inner string and out through the perforations into the formation while divertent fluid is injected into the formation through the annulus between the inner and outer strings.

As disclosed in the above-referenced U.S. Pat. No. 3,504,745, a tar sand is typically fractured prior to starting the combustion process. Fracturing may be performed through the air injection perforations. In the preferred embodiment, fracturing is performed according to the teaching in U.S. Pat. No. 3,602,308. In this method, the divertent fluid perforations are used to inject a low penetrating liquid which aids in control of fractures generated by fracturing fluid injected through the air injection perforations.

In starting the combustion process where the tar sands are at a low temperature, an additional fuel must be used to bring the formation up to burning temperatures. For this reason, in the preferred embodiment, the tubing 24 is employed so that a fuel, such as natural gas, may be conducted through tubing 24 while air is pumped in through the annulus between casing 22 and tubing 24 so that mixing and burning will occur only within the combustion zone and not further up in the casing. Once the combustion of the tar itself has begun, air may be injected through tubing 24 or through the annulus between casing 22 and tubing 24. The illustrated tubing 26 is also not essential to the air injection process but is provided for safety and control purposes in allowing temperature measurement through the combustion zone.

While the present invention has been described and illustrated in terms of specific methods and apparatus, it is apparent that modifications and changes may be made within the scope of the prsent invention as defined by the appended claims.

I claim:

1. A method of completing a combustion air injection well comprising:

assembling an outer casing string having a lower portion of a first diameter and an upper portion having a second diameter larger than said first diameter, said upper and lower portions connected by a short swage, forming threads on the inner surface of the top of said lower portion, positioning said casing string in a borehole with said swage located above a predetermined air injection level and below a predetermined divertent fluid injection level, assembling an inner casing string of essentially the same diameter as the diameter of said lower portion of said casing string, forming threads on the outer surface of the lower end of the inner casing having dimensions which mate with the threads formed on the inner surface of the lower portion of said casing string, and positioning said inner casing within said outer casing string so that said inner and outer threads match and screwing said inner casing into said outer casing.

2. A method according to claim 1 further including:

prior to positioning the inner casing within the outer casing, pumping cement into the annulus between the outer casing and the borehole and simultaneously rotating the outer casing.

3. A method according to claim 2 further including:

allowing the cement pumped into the annulus between the outer casing and the borehole to harden, and perforating the upper portion of the outer casing at the predetermined divertent fluid injection level.

4. A method according to claim 2 further including:

after screwing said inner casing into said outer casing, the step of perforating the lower portion of said outer casing at said predetermined air injection level.

5. A combustion air injection well comprising:

a borehole in the earth extending at least to a predetermined air injection depth within a hydrocarbon-bearing formation;

an outer casing string extending from the surface of the earth to said air injection depth comprising a lower portion of a first diameter, an upper portion of a second diameter larger than said first diameter, and a short swage connecting said upper and lower portions, said swage positioned above said air injection depth and below a predetermined divertent fluid injection depth; and an inner casing string having a diameter substantially the same as said first diameter, positioned within said upper portion of said outer string extending from the surface of the earth to said swage and connected to the upper end of said lower portion by means of a threaded connection.

6. A well according to claim 5 further including:

cement filling the annulus between the outer surface of said outer casing string and the inner surface of said borehole.

7. A well according to claim 6 further including first perforations through the lower portion of said outer casing and the cement at said air injection depth, and second perforations through the upper portion of said outer casing and the cement at said divertent fluid injection depth.

* * * * *